US005083710A

United States Patent [19]

McLoughlin et al.

[11] Patent Number: 5,083,710

[45] Date of Patent: Jan. 28, 1992

[54] POWDER SPRAYER WITH AUTOMATIC POWDER SUPPLY SYSTEM

[75] Inventors: Kevin McLoughlin, Tuscon, Ariz.; Walter Rice, Flemington, N.J.

[73] Assignee: Oxy-Dry Corporation, Itasca, Ill.

[21] Appl. No.: 241,040

[22] Filed: Sep. 6, 1988

[51] Int. Cl.[5] ..... B05B 5/16

[52] U.S. Cl. ..... 239/690; 239/124; 406/106; 406/153

[58] Field of Search ..... 239/651, 124, 690, 704, 239/70, 705-707; 355/247, 248, 249; 118/654; 406/93, 106, 109, 144, 153, 171

[56] References Cited

U.S. PATENT DOCUMENTS

| | | | |
|---|---|---|---|
| 628,187 | 7/1899 | Sibley | 406/153 |
| 1,444,069 | 2/1923 | Gyger | 406/93 |
| 1,458,523 | 6/1923 | Coutant | 406/93 |
| 1,487,485 | 3/1924 | Snow | 406/144 |
| 2,895,768 | 7/1959 | Bray, Jr. | 406/109 |
| 2,932,548 | 4/1960 | Nau et al. | 118/654 |
| 3,175,515 | 3/1965 | Cheely | 406/153 |
| 3,870,233 | 3/1975 | Wilhelm et al. | 239/124 |
| 4,391,860 | 7/1983 | Rotolico et al. | 406/144 |
| 4,411,388 | 10/1983 | Muck | 406/153 |
| 4,666,069 | 5/1987 | Morine et al. | 222/368 |
| 4,692,017 | 9/1987 | Maczuszenko et al. | 355/247 |
| 4,695,205 | 9/1987 | Levine | 406/106 |
| 4,787,783 | 11/1988 | Girardelli | 406/106 |
| 4,812,086 | 3/1989 | Kopernicky | 406/106 |

OTHER PUBLICATIONS

IBM Technical Disclosure Bulletin, vol. 18, No. 2, Jul., 1975, pp. 572-574 by Romankiw.

*Primary Examiner*—Robert P. Olszewski
*Assistant Examiner*—Christopher G. Trainor
*Attorney, Agent, or Firm*—Leydig, Voit & Mayer

[57] ABSTRACT

A powder supply system for a powder sprayer having a powder containing housing with a discharge opening and a roller mounted within the opening for metering the discharge of powder from the housing. The powder supply system includes first and second conduits connecting the powder supply hopper and housing, a pressurized air operated venturi tube in the first conduit for generating airflow in the first conduit for drawing powder from the hopper and directing it through the first conduit and into the housing, and a second pressurized air operated venturi tube in the second conduit for drawing excessive powder from the housing and directing it through the second conduit for return to the hopper. A control is provided for automatically operating the powder supply system in timed relation to operating time of the powder sprayer.

26 Claims, 4 Drawing Sheets

AIR PRESSURE, AIR AND POWDER
VACUUM, AIR AND POWDER
PRESS. GAUGE
PRESS. GAUGE
AIR PRESS REG.
AIR PRESS. REG.
SOLENOID ACTIVATED VALVE
INCOMING AIR FILTER
PRESSURIZED AIR SUPPLY
PRESSURE REGULATED AIR
M

POWDER SPRAYER WITH AUTOMATIC POWDER SUPPLY SYSTEM

DESCRIPTION OF THE INVENTION

The present invention relates generally to powder sprayers which have particular utility in printing presses, and more particularly, to an automatic powder supply system for such sprayers.

Roller type powder sprayers are commonly employed in printing operations for directing powder onto printed sheets prior to delivery to a stacking station in order to maintain sheet separation and prevent offset. Such roller type sprayers typically comprise a box-like, powder-containing housing having an elongated discharge opening in the bottom thereof within which an elongated roller having a relieved outer surface is rotatably disposed. As the roller is rotated, doctor blades or closely adjacent walls of the sprayer housing which define the discharge opening permit only a metered quantity of powder, as contained within the relieved areas of the roller, to be carried to a discharge zone outside the housing. Electrostatic means commonly is employed to facilitate complete removal of powder from the roller at the discharge zone.

Heretofore, problems have been incurred in maintaining a supply of powder to the sprayer housing. Conventionally, mechanically operated chains have been employed for conveying powder from a powder supply hopper to the sprayer housing. Such chains typically are directed through tubular members connecting the supply hopper and sprayer housing in order to guard against the discharge of the powder into the atmosphere. A drawback of such chain-type conveyers has been that they usually require the storage hopper to be located with the discharge end thereof substantially level with the the sprayer housing. This necessitates the inlet of the supply hopper being located at such a high elevation as to make it cumbersome to refill. Moreover, powder tends to accumulate on the chain, and after prolonged use, can create clogged conditions within the tubular members communicating between the supply hopper and the sprayer housing so as to impede operation of the sprayer. Further operational problems occur if the sprayer housing overfills, including the undesirable discharge of powder into the environment around the sprayer. Uneven filling of the sprayer housing also can result in the non-uniform discharge from the sprayer.

It is an object of the present invention to provide a system adapted for the automatic, more reliable supply of powder to sprayers in printing operations.

Another object is to provide a powder supply system that is operable for supplying powder from a supply hopper to a sprayer housing without clogging and which more reliably prevents accidental discharge of powder into the atmosphere. A related object is to provide such a powder supply system which is adapted to prevent overfilling of the sprayer housing.

A further object is to provide a powder supply system as characterized above which effects more even filling of the sprayer housing, and hence, more uniform powder distribution from the sprayer.

Still another object is to provide a powder supply system of the above kind in which the intervals and length of automatic operation can be easily selectively established. A related object is to provide such a powder supply system in which the intervals of automatic operation are governed by the operating time of the sprayer so as to prevent overfilling of the sprayer housing during periods of non-use of the sprayer.

Yet a further object is to provide a powder supply system as characterized above in which a powder supply hopper may be located remotely and at a different elevation than the sprayer so as to facilitate access to and refilling.

Other objects and advantages of the invention will become apparent upon reading the following detailed description and upon reference to the drawings, in which:

FIG. 10 is an enlarged horizontal section of the sprayer, taken in the plane of line 10—10 in FIG. 1;

Figure 1:
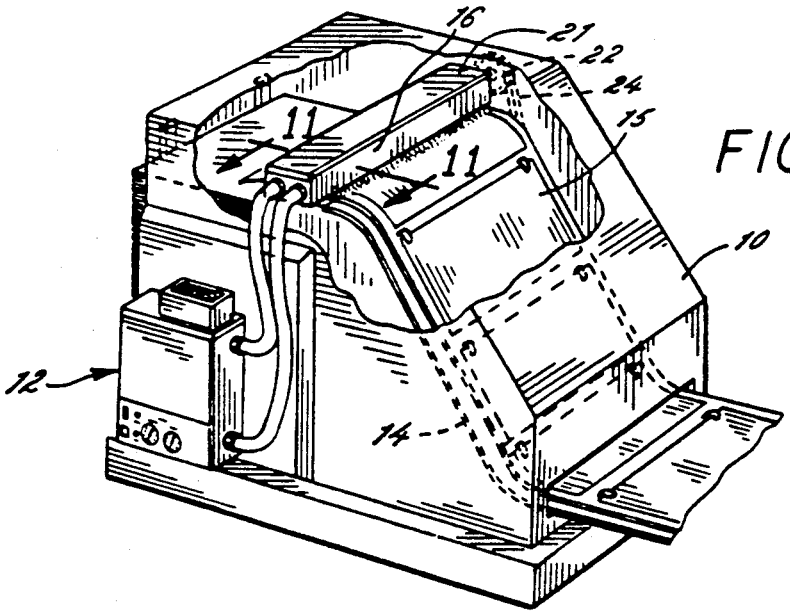
FIG. 1 is a perspective of the delivery end of a printing press having a powder sprayer with powder supply system in accordance with the present invention.
Figure 2:
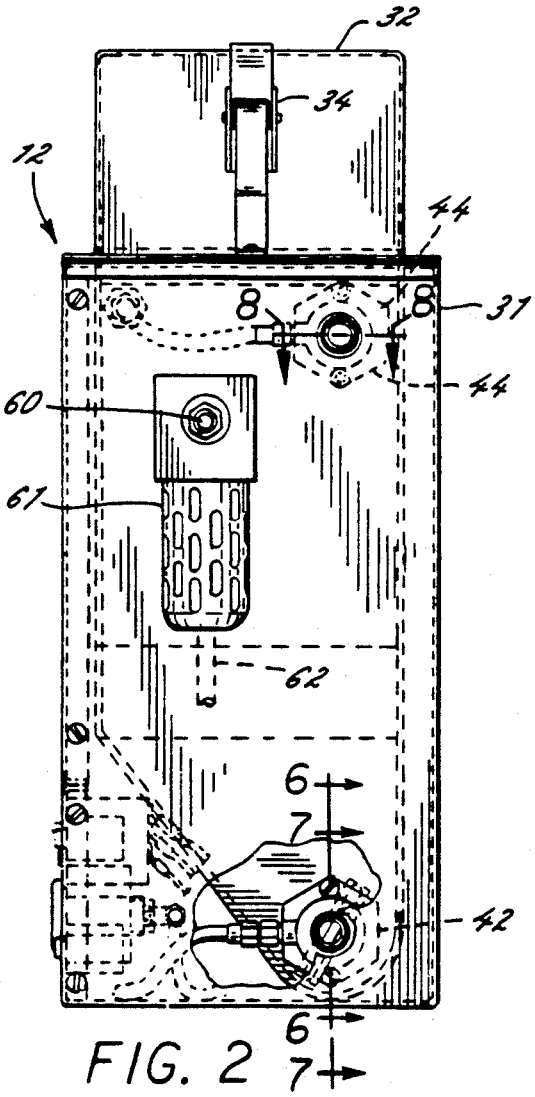
FIGS. 2 and 3 are enlarged opposite end views of the powder supply system, shown with portions broken away.
Figure 12:
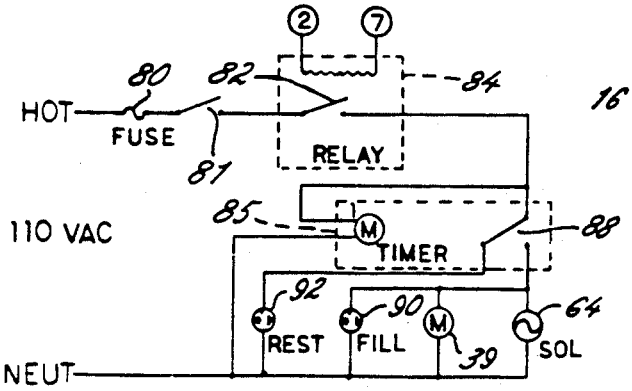
Figure 11:
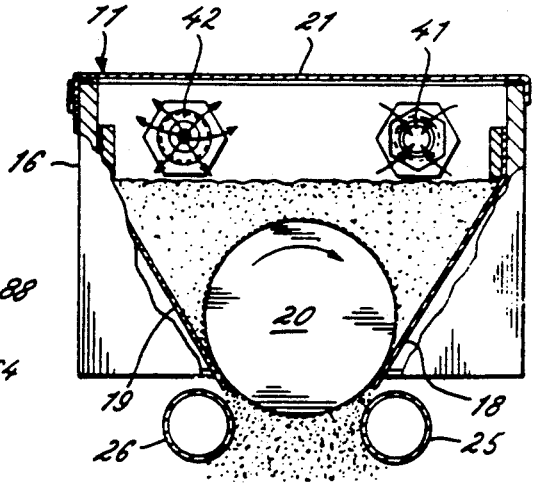
Figures 9, 10A, 10B:
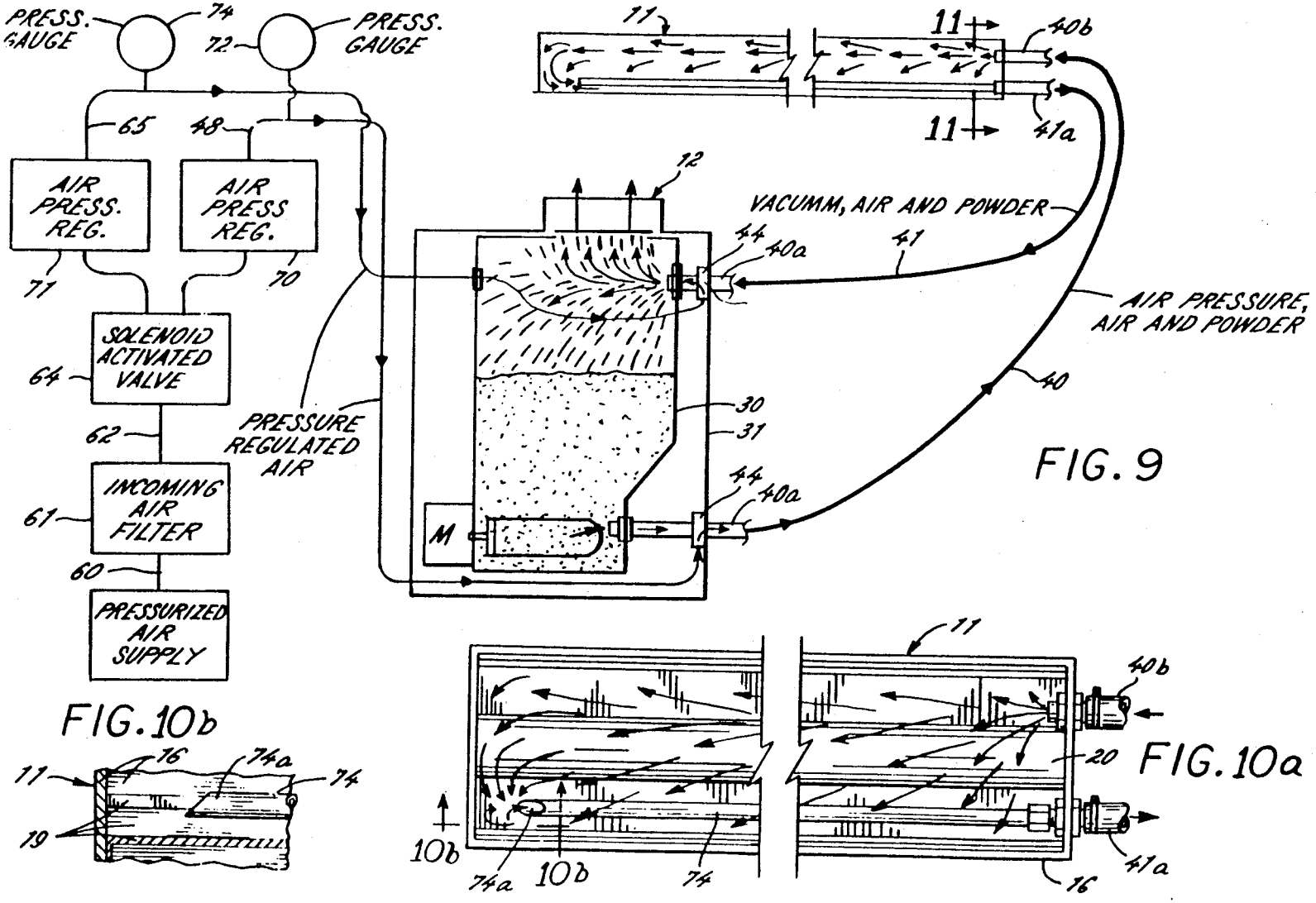
FIG. 9 is a diagrammatic illustration of the operation of the sprayer and powder supply system.

FIG. 10*a* is an enlarged fragmentary section taken in the plane of line 10*a*—10*a* in FIG. 10;

FIG. 11 is an enlarged vertical section of the sprayer taken in the plane of line 11—11 in FIG. 1; and FIG. 12 is an electrical circuit diagram of the powder supply system.

While the invention is susceptible modifications and alternative constructions, a certain illustrated embodiment thereof has been shown in the drawings and will be described below in detail. It should be understood, however, that there is no intention to limit the invention to the specific form disclosed, but on the contrary, the intention is to cover all modifications, alternative constructions and equivalents falling within the spirit and scope of the invention.

Referring now more particularly to FIG. 1 of the drawings, there is shown the inclined delivery end of a printing press 10 having a powder sprayer 11 with a powder supply system 12 in accordance with the present invention. The printing press 10 may be of any conventional type, in this case having a sheet delivery system which comprises a chain conveyer 14 with a plurality of sheet grippers for successively transferring printed sheets 15 below the sprayer 11 where powder is directed onto the sheets so as to maintain spacing and prevent offset when stacked at a delivery station.

The illustrated sprayer 11 has an elongated, powder-containing box-like housing 16 which has a trough shaped bottom formed by doctor blades 18, 19 which define an elongated bottom discharge opening within which a metering roller 20 is rotatably mounted (FIG. 11). The sprayer housing 16 has a removable cover 21 which may be pivotally mounted along one side thereof to permit access to the interior of the housing for inspecting the quantity of powder contained therein prior to startup. For driving the metering roller, the metering roller 20 has an output shaft extending from one end thereof which carries a sprocket 22 that in turn is coupled to a chain 24 which may be driven by an appropriate electric motor, or alternatively connected to the drive of the printing press so as to be operated simultaneously with the press. The metering roller 20 may be of a known type having an outer periphery formed with relieved areas.

As is known in the art, upon rotation of the metering roller 20, the doctor blades 18, 19 which are disposed in closely adjacent relation to the outer periphery of the roller 20, permit only a metered quantity of powder, as contained within the relieved areas of the roller, to be carried through the discharge opening. To effect removal of the powder from the surface of roller after proceeding through the discharge opening, electrostatic means, is provided, which in this case includes a pair of tubular electrodes 25, 26 mounted in closely adjacent relation below opposite sides of the elongated discharge opening. The electrodes may be charged to relatively high voltages, such as on the order of 10,000 volts, so as to create a corona zone about the underside of the metering roller 20 which has the effect of blasting the powder from the relieved areas of the outer peripheral surface of the metering roller and preventing build up of powder on the housing about the discharge opening.

For providing a supply of powder to the sprayer housing 16, the powder supply system 12 includes a hopper 30 which may be located remotely from the sprayer housing 16, in this case being mounted adjacent one side thereof. The hopper 30 is contained within an outer housing 31 of the powder supply system 12, and for printing operations, preferably is sized to hold from twelve to sixty pounds of powder. The hopper 30 has a pivotably mounted lid 32 which may be opened to permit refilling of the hopper or inspection of the level of the powder within the hopper. A latch 34 is provided for securing the lid in closed position. The lid 32 preferably has an appropriate sealing gasket about its periphery so as to prevent the escape of powder from the hopper when operating. An agitator 36 is rotatably disposed in the bottom of the powder supply hopper for continuously stirring the powder during operation of the powder supply system 12. The agitator 36 has an elongated generally rectangular configuration extending substantially across the width of the hopper 30, and a drive shaft 38 rotatably mounted in a wall of the supply hopper, which is rotatably driven by an electric motor 39.

In accordance with the invention, the powder supply system is operable for automatically delivering powder to the sprayer housing in timed relation to the sprayer operation while simultaneously preventing overfilling of the sprayer housing. More particularly, first and second conduit means connect the powder supply hopper and housing and means are provided for generating a pressurized airflow in the first conduit for drawing powder from the hopper and directing it through the first conduit and into said housing, and means are provided for generating a pressurized airflow in the second conduit for drawing excess powder from the housing and directing it through the second conduit for return to the hopper. In the illustrated embodiment, a first or supply conduit 40 is provided which has an inlet **40*a* connected adjacent the bottom of the powder supply hopper 30 and an outlet 40*b* connected to an end of sprayer housing 16 adjacent the top thereof. A return conduit 41 is provided which has an inlet 41*a* also connected to the end of the sprayer housing 16 adjacent the top thereof and an outlet 41*b* connected to and communicating wit the top of the supply hopper 30. The conduits 40, 41 preferably are flexible tubular members of sufficient length to permit mounting of the supply hopper 30 at any convenient accessible location remote from the sprayer housing 16**.

For generating the desired airflows within the supply and return conduits 40, 41 an airflow amplifying venturi tube 42 is mounted in the supply conduit 40 adjacent the inlet thereof and a second airflow amplifying venturi tube 44 is mounted in the return conduit 41 adjacent the outlet thereof. The venturi tubes 42, 44 may be of a known type, such as offered by AXD Service Ind. Corp., Trennent, N.J., under the trademark AER-X-DUST. The venturi tube 42 has a central passageway 45 communicating between upstream and downstream ends **45*a*, 45*b* thereof, respectively and a radially directed pressurized air inlet port 46 which is connected to a pressurized air supply line 48. The inlet port 46 communicates with an annular port 49 which in turn communicates with an annular orifice 50. Pressurized air is directed through the inlet port 46 and annular port 49 and is throttled through the annular orifice 50 at a high velocity in a downstream direction parallel to the axis of the venturi tube. A low pressure area is thereby created adjacent the upstream end 45*a* of the venturi tube, thus allowing atmospheric pressure to force ambient air into the upstream end of the central passage 45. This creates a high velocity airflow through the venturi tube, creating a suction pressure at the upstream end which draws in air and powder from the powder supply hopper 30 and forcefully directs it into and through the supply conduit 40**.

The venturi tube 44 for the return conduit 41 is similar, but is reversely oriented with an outlet end **54*a* of a central passage 54 being directed toward the supply hopper 30 and the inlet end 54*b* coupled to the return line 41. The pressurized airflow through a radial inlet port 55 creates a high velocity airflow into the supply hopper 30 and a suction pressure within the return conduit 41 which communicates with the sprayer housing 16**.

For supplying pressurized air to the venturi tubes 42, 44, a supply line 60 coupled to a pump or other outside pressurized air source communicates through a filter 61, which may be an air filter/water separator for removing both moisture and solid particles from the airflow. Preferably, the pressurized air supply should be capable of providing a minimum of 8 cfm at 80 psi. The air filter 61 is connected by a line 62 to a normally closed solenoid control valve 64 which in turn has a pair of output lines 48, 65 connected respectively to the venturi tube radial inlets 46, 55. Pressure regulators 70, 71 are connected in the lines 48, 65 respectively, for establishing a constant output of pressure through the venturi tubes, notwithstanding changes in the supply pressure or in the downstream flow requirements. The pressure regulators 70, 71 may be of a known selectively adjustable type, and to facilitate establishing the desired pressurized airflows, pressure gauges 72, 74 coupled to the respective lines 48, 65 are mounted in the housing 31.

In keeping with the invention, air flows within the supply and return conduits are selectively established so that a slightly greater airflow occurs in the return conduit 41 then in the supply conduit 40. Such condition not only insures the return of excess powder within the sprayer housing 16 so as to prevent overfilling, but also creates a slight negative pressure within the sprayer housing 16 to prevent escape of powder from the sprayer housing during a sprayer operation. To prevent a significant pressure build up within the supply housing 16, the top of the cover 32 is in the form of a grid 70 which defines a plurality of air discharge openings and a filter 71, which in this case is in the form of a rectangular block of sponge material, is mounted within the cover 32 on the underside of the grill. The filter 71 allows air to escape from the powder supply hopper 30 to relieve pressure build, while filtering out airborne powder.

For supplying a substantially uniform distribution of powder along the length of the sprayer housing 16 during a fill operation, the outlet **40*b* of the supply conduit 40 communicates with one end of the sprayer housing and the inlet 41*a* of the return conduit 41 communicates with an opposite end of the sprayer housing. In the illustrated embodiment, the outlet of the supply conduit 40 discharges into the end of the sprayer housing adjacent the location where the return conduit 41 is connected, and the return conduit 41 has a tubular extension 74 which extends the length of the sprayer housing 16 and has an inlet 74*a* adjacent the opposite end. The extension 74 preferably has its terminal end cut at an angle to the horizontal, such as on the order of 45°, so that the inlet 74*a* communicates in a generally upward direction and suction pressure within the return conduit 41 tends to draw air and powder in from the upper portion of the sprayer housing. Since the powder discharging from the supply conduit 40 enters at one end of the sprayer housing and the return line 41** communicates with the opposite end, it has been found that powder tends to be distributed substantially over the length of the sprayer housing, and thus, tends to insure more uniform discharge from the sprayer.

In carrying out another important aspect of the invention, control means is provided for periodically operating the powder supply system 12, based upon operating time of the sprayer 11, so as to prevent overfilling of the spraying housing 16 during periods of non-use of the sprayer. In the illustrated embodiment, as depicted in FIG. 9, power to the powder supply system 12, which may be a conventional 110 volt power source, is communicated through a fuse 80 and a switch 81 which is manually closed to activate the system. When the switch 81 is closed, power is fed to a normally open contact 82 of a control relay 84 which is activated by the power supply for the sprayer 11, such as the power supply to a motor for the metering roller 20. Upon operation of the sprayer, which typically is operated in unison with the press 10, the normally open contact 82 of the relay 84 is closed and power is fed to an electro-mechanical timer 85. The timer 85 is of a type which operates only when energized, and thus measures only the operating time of the sprayer 11. The timer 85, includes mechanical segments of trippers 86 which act to close a normally open contact 88 after a predetermined period of sprayer operation, thereby energizing and opening the normally closed solenoid 64 to the permit communication of pressurized air from the supply line 60 to the lines 48, 65 and supply and return conduit venturi tubes 42, 44, respectively, and to also energize the supply hopper agitator motor 39 and the indicator light 90 on the control panel indicating that the powder supply system 12 is in its filling cycle.

Figure 3:
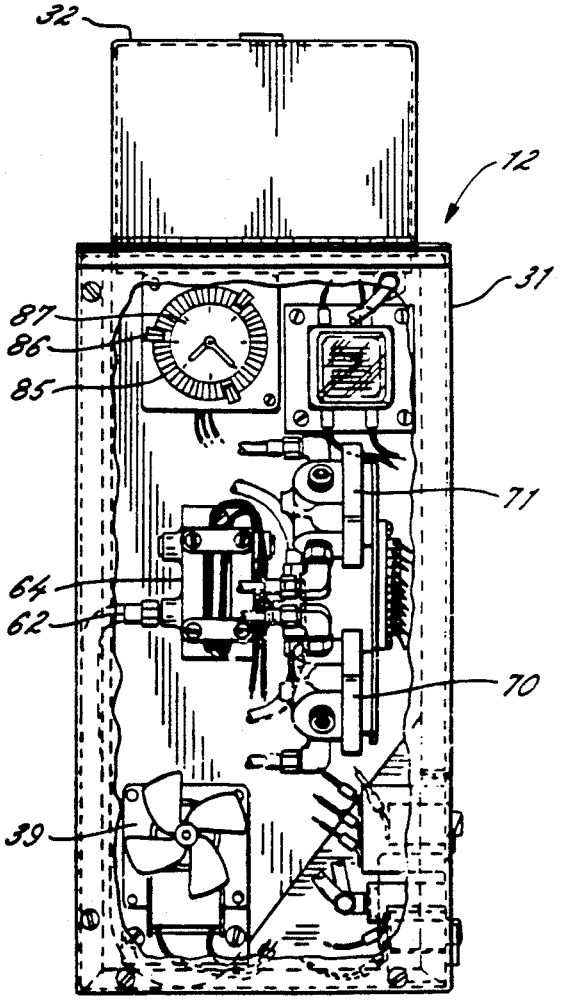
Figure 4:
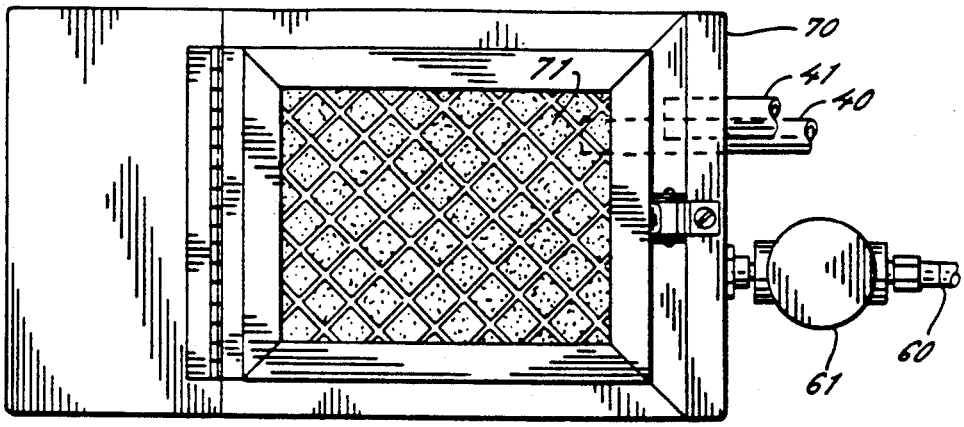
FIG. 4 is a top view of the powder supply shown in FIGS. 2 and 3.
Figure 5:
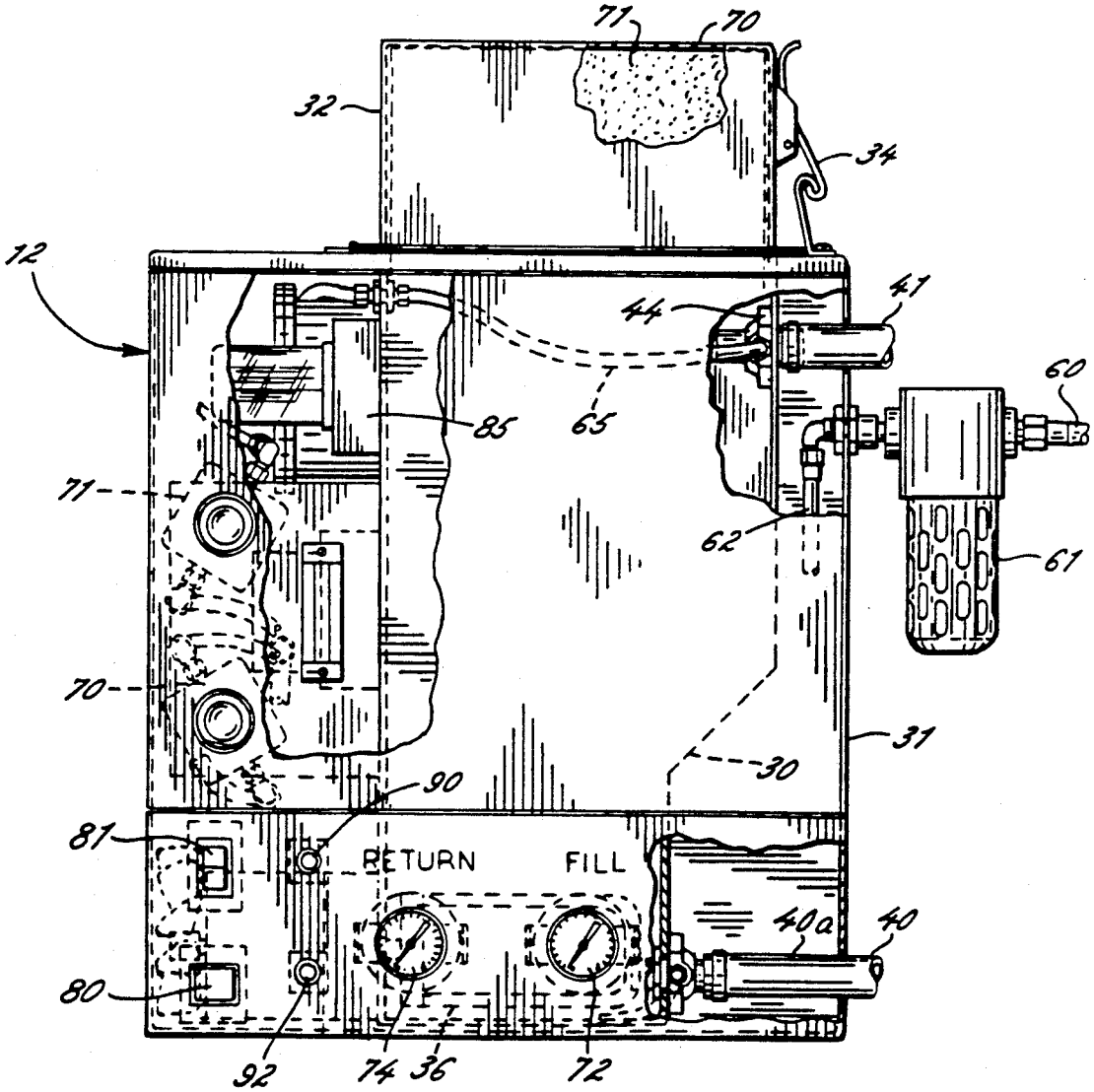
FIG. 5 is a side elevational view of the powder supply system, shown partially broken away.
Figure 6:
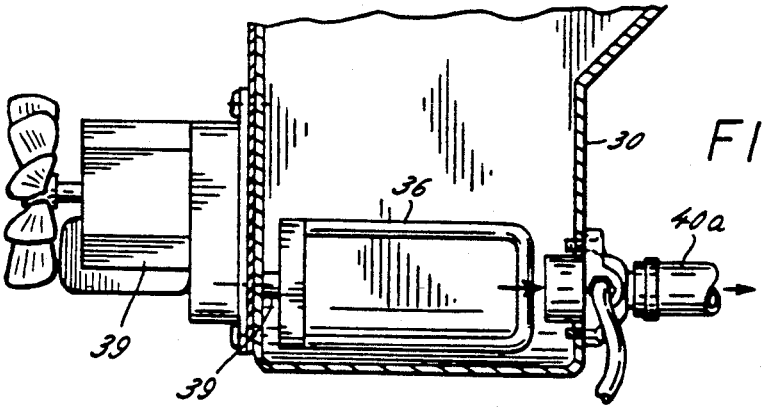
FIG. 6 is an enlarged fragmentary section of the powder supply hopper and agitator, taken in the plane of line 6—6 in FIG. 2.
Figure 7:
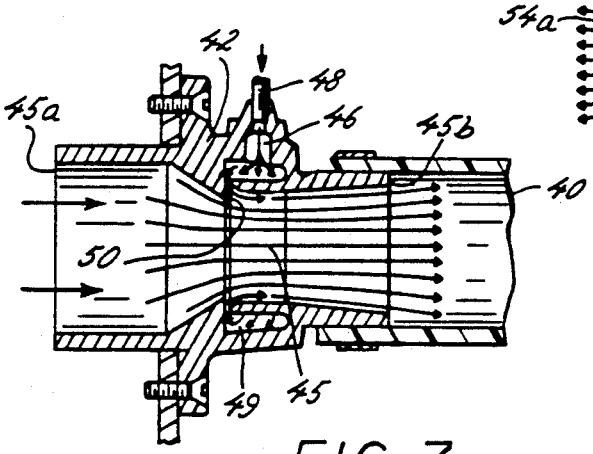
FIG. 7 is an enlarged fragmentary section of the air directing venturi in the supply conduit of the powder supply system, taken in the plane of line 7—7 in FIG. 2.
Figure 8:
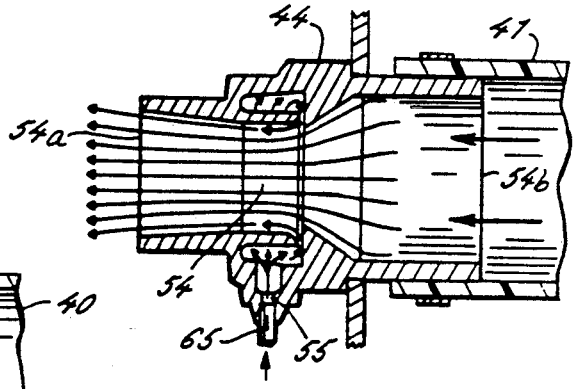
FIG. 8 is an enlarged fragmentary section of the air directing venturi in the return conduit of the powder supply system, taken in the plane of line 8—8 in FIG. 2.

The timer 85 may be a quartz electro-mechanical time control switch having twenty four hour programming, such as manufactured by Dayton Electric Manufacturing Co., Chicago, Ill. Such timer has one hundred forty four captive segments 86 for minimum programming of ten minutes, so as to allow for custom programming of "fill" and "rest" cycles of the powder supply system 12 for selectively meeting the requirements of the sprayer 11. The segments 85 are arranged in a circumferential pattern about a clock 87, and by radially moving outwardly single segments at 120° intervals, the timer is adapted for mechanically closing the contact 88, and thus operate the powder supply system 12 for ten minutes every eight hours. By manually moving two adjacent segments outwardly at 120° intervals, as illustrated in FIG. 3, the timer will operate twenty minutes every eight hours. Likewise, moving segments to their outer position at 90° intervals, would operate the system at six hour intervals.

When the period set for the length of the fill cycle of the powder supply system 12 is completed, as determined by a number of adjacent segments 86 moved in their outer position, the segments 86 will release the contact 88 which will be returned to its normally open position. The solenoid valve 64 is thereupon de-energized, stopping the flow of air to the supply and return conduit venturi tubes 44, 48, the fill light 90 is de-energized, and a rest light 92 is energized, indicating that the power to the supply system is on, but that the powder supply system is in a rest condition. Since the timer 85 will operate only when the sprayer 11 is operating and the contact 82 is closed, it can be seen that the operation of the powder supply system 12 is based upon the operating time of the sprayer, rather than actual time, so that the "fill" and "rest" cycles of the powder supply system remain synchronized with the powder usage.

In operation of the powder supply system 12, the operator will first estimate the time required to fill the sprayer housing 16 and the frequency in which it must be refilled, which will depend upon the size of the housing and the operating speed of the sprayer 11. The timer segments 86 may be easily set to establish the desired intervals of operation and the length of intervals of operation. During a printing operation, after the requisite interval of operating time of the sprayer has passed, as measured by the timer 85, the switch 88 is closed to actuate the solenoid 64, and energize the motor 39 of the agitator to initiate the fill cycle. During the fill cycle, pressurized air is communicated through the supply line 60, air filter 61, solenoid 64, and lines 48, 65 communicating with the venturi tubes 42, 44 creating an airflow through the supply conduit 40 which draws powder from the supply hopper 30 and discharges it into the sprayer housing and an airflow through from the extension tube 74 of the return conduit 41 for drawing excess powder that may accumulate within the sprayer housing and directing it through the return conduit 41 to the supply hopper. Since the pressure regulators preferably set to provide a slightly greater airflow in the return line 41 than in the supply line 40, excess air directed into the supply hopper discharges through the lid filter 71. The intervals of operation and the length of operating time of the powder supply system may be easily changed through adjustment of the time 85 and adjustments in the pressure regulators 70, 71 may be made to provide optimum air and pressure conditions within the fill and return conduits for effecting uniform filling of the sprayer housing.

From the foregoing, it can be seen that since the powder supply system of the present invention is essentially a closed pneumatic system, which is operable for continually withdrawing excessive powder from the sprayer housing, the system can be more reliably operated without clogging or accidental discharge of powder into the atmosphere. The powder supply system also is adapted for more uniform filling of the sprayer housing, and hence, facilitates more uniform powder distribution from the sprayer. Since the automatic operation of the powder supply system is timed in relation to the sprayer on time, rather than actual time, the fill and rest cycles of the sprayer supply system are synchronized with the actual powder usage so as to prevent overfilling of the sprayer housing during periods of non-use of the sprayer. Moreover, since the fill and return conduits connecting the powder supply hopper and sprayer housing may be flexible plastic lines or the like, the powder supply hopper may be located remotely of the sprayer and at a different elevation so as to facilitate access to and refilling.

We claim as our invention:

1. In a printing press having means for transferring sheet material along a predetermined path, a powder sprayer for directing anti-offset powder onto said sheet material, said powder sprayer comprising a housing for containing a quantity of powder, said housing having an elongated, substantially horizontally disposed discharge opening, a rotatable roller disposed within said opening for metering the discharge of powder from said housing through said discharge opening, a powder supply hopper remote from said housing, first and second conduits connecting said powder supply hopper and housing, said first conduit communicating with said sprayer housing adjacent one end of said discharge opening and said second conduit communicating with said sprayer housing adjacent an opposite end of said discharge opening, first means for generating a pressurized air flow in said first conduit for drawing powder from said hopper and directing it through said first conduit and into said housing, at a location adjacent said one end of said discharge opening, and second means separate from said first pressurized airflow generating and directing means for generating a pressurized air flow in said second conduit for drawing excess powder from said housing at a location adjacent the opposite end of said discharge opening and directing it through said second conduit for return to said hopper.

2. In the printing press of claim 1 in which said roller has an outer peripheral surface formed with relieved areas, and said housing includes doctor blades means in adjacent relation to the outer periphery of said roller for limiting the discharge of powder to that carried within the relieved areas of said roller.

3. In the printing press of claim 2 including electrostatic means for effecting substantially complete removal of powder from said roller.

4. In the printing press of claim 3 in which said electrostatic means includes at least one electrode disposed outside said housing in adjacent relation to said discharge opening, and means for applying a relatively high voltage to said electrode.

5. In the printing press of claim 1 in which said powder hopper includes a motor driven agitator for mixing powder contained therein.

6. In the printing press of claim 5 in which said agitator extends substantially across the bottom of said hopper, and said first conduit has an inlet connected to said hopper adjacent said agitator.

7. A printing press power sprayer for directing powder onto sheets passing through the printing press comprising a housing for containing a quantity of powder selectively operable means for discharging powder from said housing, a powder supply hopper, means for transferring powder from said hopper to said housing, and means for automatically operating said powder transferring means in timed intervals in response to and as determined by the operating time of said powder discharging means.

8. The printing press powder sprayer of claim 7 in which said automatic operating means includes timer means operated in response to operation of said powder discharging means, and means responsive to operation of said timer means for a predetermined period for initiating operation of said powder transferring means.

9. The printing press powder sprayer of claim 8 in which said timer means includes means responsive to a predetermined period following initiation of operation of said powder transferring means for interrupting operation of said powder transferring means.

10. The printing press powder sprayer of claim 7 in which said powder transferring means includes first and second conduits connecting said powder supply hopper and housing, means for generating a pressurized airflow in said first conduit for drawing powder from said hopper and directing it through said first conduit and into said housing, and means for generating a pressurized airflow in said second conduit and for drawing excess powder from said housing and directing it through said second conduit for return to said hopper.

11. In a printing press having means for transferring sheet material along a predetermined path, a powder sprayer for directing anti-offset powder onto said sheet material, said powder sprayer comprising a housing for containing a quantity of powder, said housing having an elongated, substantially horizontally disposed discharge opening, a rotatable roller disposed within said opening for metering the discharge of powder from said housing through said discharge opening, a powder supply hopper remote from said housing, first and second conduits connecting said powder supply hopper and housing, said first conduit communicating with said sprayer housing adjacent one end of said discharge opening and said second conduit communicating with said sprayer housing adjacent an opposite end of said discharge opening, means for generating a pressurized air flow in said first conduit for drawing powder from said hopper and directing it through said first conduit and into said housing at a location adjacent said one end of said discharge opening, said first conduit air generating and directing means including first venturi means having a central air passageway with an inlet coupled to said hopper and an outlet coupled to said sprayer housing, said first venturi means having radial inlet passage means through which a pressurized air flow stream is directed for generating an air flow through said central passageway and first conduit, and means for generating a pressurized air flow in said second conduit for drawing excess powder from said housing at a location adjacent the opposite end of said discharge opening and directing it through said second conduit for return to said hopper, said second conduit air generating and directing means including second venturi means having a central passageway with an inlet coupled to said sprayer housing and an outlet coupled to said hopper, said second venturi means having radial inlet passage means through which a pressurized airflow stream is directed for generating an airflow through said central passageway and second conduit.

12. The sprayer of claim 11 in which said radial inlet passage means of said venturi means are configured so that upon direction of a pressurized airflow stream through said radial passage means air also is drawn through said venturi means inlets and central passage for direction into said respective conduit.

13. A powder sprayer comprising a housing for containing a quantity of powder, said housing having an elongated discharge opening, a rotatable roller disposed within said opening for metering the discharge of powder from said housing through said discharge opening, a powder supply hopper remote from said housing, first and second conduits connecting said powder supply hopper and housing, means for generating a pressurized air flow in said first conduit for drawing powder from said hopper and directing it through said first conduit and into said housing, means for generating a pressurized air flow in said second conduit for drawing excess powder from said housing and directing it through said second conduit for return to said hopper, said second conduit air generating and directing means being operable for generating a greater air flow than said first conduit air generating and directing means, said hopper including a removable lid having an air passage opening therein, and filter means contained in said lid for filtering air directed through said second conduit into said hopper and through said air passage opening.

14. The sprayer of claim 13 in which said filter means is a block of sponge material contained within the underside of said lid.

15. A powder sprayer comprising a housing for containing a quantity of powder, said housing having an elongated discharge opening, a rotatable roller disposed within said opening for metering the discharge of powder from said housing through said discharge opening, a powder supply hopper remote from said housing, first and second conduits connecting said powder supply hopper and housing, means for generating a pressurized air flow in said first conduit for drawing powder from said hopper and directing it through said first conduit and into said housing, means for generating a pressurized air flow in said second conduit for drawing excess powder from said housing and directing it through said second conduit for return to said hopper, said first and second conduit airflow generating means including a pressurized air source, selectively operable control means for automatically communicating said pressurized air source to said first and second conduit airflow generating means in predetermined timed intervals, said control means including timer means operated in response to operation of said roller, and means responsive to operation of said timer means for a predetermined period for enabling communication of said pressurized air source to said first and second conduit airflow generating means.

16. The sprayer of claim 15 in which said control means is a conduit valve coupled between said pressurized air source and said first and second conduit airflow generating means.

17. The sprayer of claim 16 in which said timer means includes a clock operated in response to operation of said roller, said clock having a plurality of selectively setable segments that are movable in timed relation to operation of said clock, and control relay means actuatable by said segments after a predetermined period of operation of said clock, and means responsive to actuation of control relay means for actuating said control valve means.

18. The sprayer of claim 17 including means responsive to operation of said clock for a predetermined period following actuation of said control relay means for deactuating said control relay means and control valve means for interrupting communication between said pressurized air source and said first and second conduit airflow generating means.

19. A powder sprayer comprising a housing for containing a quantity of powder, said housing having an elongated, substantially horizontally disposed discharge opening, a rotatable roller disposed within said opening for metering the discharge of powder from said housing through said discharge opening, a powder supply hopper remote from said housing, first and second conduits connecting said powder supply hopper and housing, said first conduit communicating with said sprayer housing on one end of said discharge opening and said second conduit communicating with said sprayer housing on an opposite end of said discharge opening, means for generating a pressurized air flow in said first conduit for drawing powder from said hopper and directing it through said first conduit and into said housing at said one end of said discharge opening, and means for generating a pressurized air flow in said second conduit for drawing excess powder in said housing from said opposite end of said discharge opening and directing it through said second conduit for return to said hopper.

20. A powder sprayer comprising a housing for containing a quantity of powder, said housing having an elongated discharge opening, a rotatable roller disposed within said opening for metering the discharge of powder from said housing through said discharge opening, a powder supply hopper remote from said housing, first and second conduits connecting said powder supply hopper and housing, said first and second conduits being connected to a common end of said sprayer housing, one of said conduits communicating directly with the interior of said sprayer housing adjacent said one end, and the other of said conduits having an extension tube extending substantially the length of said housing with the end of the tube communicating with the interior of said housing at the other end thereof;

means for generating a pressurized air flow in said first conduit for drawing powder from said hopper and directing it through said first conduit and into said housing, and means for generating a pressurized air flow in said second conduit for drawing excess powder from said housing and directing it through said second conduit for return to said hopper.

21. The powder sprayer of claim 20 in which said extension tube is connected to said second conduit, and said extension tube has an angled terminal end for defining an inlet opening therein oriented in an upward direction.

22. In a printing press having means for transferring sheet material along a predetermined path, a powder sprayer for directing anti-offset powder onto said sheet material, said powder sprayer comprising a housing for containing a quantity of powder, said housing having an elongated discharge opening, a rotatable roller disposed within said opening for metering the discharge of powder from said housing through said discharge opening, a powder supply hopper remote from said housing, first and second conduits connecting said powder supply hopper and housing, first means for generating a pressurized air flow in said first conduit for drawing powder from said hopper and directing it through said first conduit and into said housing, second means separate from said first pressurized airflow generating and directing means for generating a pressurized air flow in said second conduit for drawing excess powder from said housing and directing it through said second conduit for return to said hopper, and said second conduit air generating and directing means being operable for generating a greater air flow than said first conduit air generating and directing means.

23. In a printing press having means for transferring sheet material along a predetermined path, a powder sprayer for directing anti-offset powder onto said sheet material, said powder sprayer comprising a housing for containing a quantity of powder, said housing having an elongated discharge opening, a rotatable roller disposed within said opening for metering the discharge of powder from said housing through said discharge opening, a powder supply hopper remote from said housing, first and second conduits connecting said powder supply hopper and housing, first means for generating a pressurized air flow in said first conduit for drawing powder from said hopper and directing it through said first conduit and into said housing, second means separate from said first pressurized airflow generating and directing means for generating a pressurized air flow in said second conduit for drawing excess powder from said housing and directing it through said second conduit for return to said hopper, said first and second conduit air generating and directing means being selectively operable, and means for automatically operating said first and second conduit air generating and directing means in timed intervals in response to and as determined by the operating time of said roller.

24. In the printing press of claim 23 in which said automatic operating means includes timer means operated in response to operation of said roller, and means responsive to operation of said timer means for a predetermined period for initiating operation of said first and second conduit on generating and directing means.

25. In the printing press of claim 24 in which said timer means includes means responsive to a predetermined period following initiation of operation of said first and second conduit on generating and directing means for interrupting operation of said first and second air generating and directing means.

26. In a printing press having means for transferring sheet material along a predetermined path, a powder sprayer for directing anti-offset powder onto said sheet material, said powder sprayer comprising a housing for containing a quantity of powder, said housing having an elongated discharge opening, a rotatable roller disposed within said opening for metering the discharge of powder from said housing through said discharge opening, a powder supply hopper remote from said housing, first and second conduits connecting said powder supply hopper and housing, first means for generating a pressurized air flow in said first conduit for drawing powder from said hopper and directing it through said first conduit and into said housing, second means separate from said first pressurized airflow generating and directing means for generating a pressurized air flow in aid second conduit for drawing excess powder from said housing and directing it through said second conduit for return to said hopper, said first and second conduit air flow generating means including a pressurized air source, and selectively operable control means for automatically communicating said pressurized air source to said first and second conduit airflow generating means in predetermined timed intervals.

* * * * *